US010018419B2

(12) United States Patent
Pilote et al.

(10) Patent No.: US 10,018,419 B2
(45) Date of Patent: Jul. 10, 2018

(54) SOLIDS INJECTION LANCE

(71) Applicant: TaTa Steel Ltd., Mumbai (IN)

(72) Inventors: Jacques Pilote, Woodlands (AU); Rodney James Dry, City Beach (AU); Michael Anthony Hutton, Yangebup (AU)

(73) Assignee: TaTa Steel Limited, Mumbai (IN)

( * ) Notice: Subject to any disclaimer, the term of this patent is extended or adjusted under 35 U.S.C. 154(b) by 139 days.

(21) Appl. No.: 14/889,018

(22) PCT Filed: May 2, 2014

(86) PCT No.: PCT/AU2014/000487
§ 371 (c)(1),
(2) Date: Nov. 4, 2015

(87) PCT Pub. No.: WO2014/179825
PCT Pub. Date: Nov. 13, 2014

(65) Prior Publication Data

US 2016/0153715 A1 Jun. 2, 2016

(30) Foreign Application Priority Data

May 6, 2013 (AU) ..... 2013901599

(51) Int. Cl.

| | |
|---|---|
| ***F27D 3/18*** | (2006.01) |
| ***C21B 7/24*** | (2006.01) |
| ***C21C 5/46*** | (2006.01) |
| ***F27D 3/00*** | (2006.01) |
| *C21B 7/16* | (2006.01) |
| *F27D 3/16* | (2006.01) |
| *F27D 21/00* | (2006.01) |

(52) U.S. Cl.
CPC ..... *F27D 3/18* (2013.01); *C21B 7/24* (2013.01); *C21C 5/4606* (2013.01); *F27D 3/0033* (2013.01); *F27D 3/16* (2013.01); *C21B 7/163* (2013.01); *C21C 5/4673* (2013.01); *C21C 2005/4626* (2013.01); *F27D 2003/164* (2013.01); *F27D 2003/168* (2013.01); *F27D 2003/169* (2013.01); *F27D 2021/0007* (2013.01)

(58) Field of Classification Search
CPC ..... F27D 3/18; F27D 3/0033
See application file for complete search history.

(56) References Cited

U.S. PATENT DOCUMENTS 4,519,587 A * 5/1985 Peckels ..... C21C 5/4606 266/216
6,398,842 B2 6/2002 Dunne
2016/0153715 A1* 6/2016 Pilote ..... C21B 7/24 75/707

FOREIGN PATENT DOCUMENTS

DE 102005061589 A1 7/2006
JP 3151803 B2 4/2001
(Continued)

OTHER PUBLICATIONS

Jun. 25, 2014—International Search Report—PCT/AU2014/000487.

*Primary Examiner* — Scott Kastler
(74) *Attorney, Agent, or Firm* — Banner & Witcoff, Ltd.

(57) ABSTRACT

A solids injection lance includes (a) a tube that defines a passageway for solid feed material to be injected through the tube and has an inlet for solid material at a rear end and an outlet for discharging solid material at a forward end of the tube and (b) a puncture detection system for detecting a puncture in the solids injection tube.

20 Claims, 3 Drawing Sheets

(56) References Cited

FOREIGN PATENT DOCUMENTS

| | | | |
|---|---|---|---|
| JP | 3406648 | B2 | 5/2003 |
| WO | 1996/031627 | A1 | 10/1996 |
| WO | 2006/105578 | A1 | 10/2006 |

* cited by examiner

SOLIDS INJECTION LANCE

CROSS-REFERENCE TO RELATED APPLICATIONS

The present application is a U.S. National Phase filing of International Application No. PCT/AU2014/000487, filed on May 2, 2014, designating the United States of America and claiming priority to Australian Patent Application No. 2013901599 filed May 6, 2013, and the present application claims priority to and the benefit of both the above-identified applications, which are incorporated by reference herein in their entireties.

TECHNICAL FIELD

The present invention relates to a lance for injecting solid material into a vessel, such as a molten bath-based direct smelting vessel for producing molten metal, such as iron.

The present invention also relates to a process and apparatus for smelting a metalliferous material, such as an iron-containing material, such as an iron ore, and producing molten iron.

BACKGROUND ART

A known molten bath-based smelting process is generally referred to as the "HIsmelt" process and is described in a considerable number of patents and patent applications in the name of the applicant.

The HIsmelt process is applicable to smelting metalliferous material generally but is associated particularly with producing molten iron from iron ore or another iron-containing material.

In the context of producing molten iron, the HIsmelt process includes the steps of:

(a) forming a bath of molten iron and slag in a main chamber of a direct smelting vessel;

(b) injecting into the molten bath: (i) iron ore, typically in the form of fines; and (ii) a solid carbonaceous material, typically coal, which acts as a reductant of the iron ore feed material and a source of energy; and (c) smelting iron ore to iron in the bath.

The term "smelting" is herein understood to mean thermal processing wherein chemical reactions that reduce metal oxides take place to produce molten metal.

In the HIsmelt process solid feed materials in the form of metalliferous material (which may be pre-heated) and carbonaceous material are injected with a carrier gas into the molten bath through a number of water-cooled solids injection lances which are inclined to the vertical so as to extend downwardly and inwardly through the side wall of the main chamber of the smelting vessel and into a lower region of the vessel so as to deliver at least part of the solid feed materials into the metal layer in the bottom of the main chamber. The solid feed materials and the carrier gas penetrate the molten bath and cause molten metal and/or slag to be projected into a space above the surface of the bath and form a transition zone. A blast of oxygen-containing gas, typically oxygen-enriched air or pure oxygen, is injected into an upper region of the main chamber of the vessel through a downwardly extending lance to cause post-combustion of reaction gases released from the molten bath in the upper region of the vessel. In the transition zone there is a favourable mass of ascending and thereafter descending droplets or splashes or streams of molten metal and/or slag which provide an effective medium to transfer to the bath the thermal energy generated by post-combusting reaction gases above the bath.

Typically, in the case of producing molten iron, when oxygen-enriched air is used, the oxygen-enriched air is generated in hot blast stoves and fed at a temperature of the order of 1200° C. into the upper region of the main chamber of the vessel. If technical-grade cold oxygen is used, the technical-grade cold oxygen is typically fed into the upper region of the main chamber at or close to ambient temperature.

Off-gases resulting from the post-combustion of reaction gases in the smelting vessel are taken away from the upper region of the smelting vessel through an off-gas duct.

The smelting vessel includes a main chamber for smelting metalliferous material and a forehearth connected to the main chamber via a forehearth connection that allows continuous metal product outflow from the vessel. The main chamber includes refractory-lined sections in a lower hearth and water-cooled panels in side walls and a roof of the main chamber. Water is circulated continuously through the panels in a continuous circuit. The forehearth operates as a molten metal-filled siphon seal, naturally "spilling" excess molten metal from the smelting vessel as it is produced. This allows the molten metal level in the main chamber of the smelting vessel to be known and controlled to within a small tolerance this is essential for plant safety. Molten metal level must (at all times) be kept at a safe distance below water-cooled elements such as solids injection lances extending into the main chamber, otherwise steam explosions become possible.

The HIsmelt process enables large quantities of molten iron, typically at least 0.5 Mt/a, to be produced by smelting in a single compact vessel.

One example of the construction of a solids injection lance for use in the smelting vessel can be found in U.S. Pat. No. 6,398,842 (assigned to the present applicant). This form of lance can be used to inject solid particulate material, such as metalliferous material or carbonaceous material, into the smelting vessel. Typically, the metalliferous material and carbonaceous material are injected through separate lances. The metalliferous material may be pre-heated. Metalliferous material and carbonaceous material may be co-injected through one lance.

The lance disclosed in U.S. Pat. No. 6,398,842 includes a central core tube and an outer annular cooling jacket. The core tube is fitted closely within the cooling jacket. In use, solid particulate material is passed through the central core tube and discharged from a forward tip end of the lance. A forced internal cooling water system is provided within the outer annular cooling jacket to allow the lance to operate successfully when exposed to the high temperatures encountered within a direct smelting vessel, which can be in excess of 1400° C. in the case of smelting iron ore as the metalliferous material.

Metalliferous material and carbonaceous material can be abrasive and therefore abrasive wear is a consideration in the design of a solids injection lance for the smelting vessel. This is particularly the case when the smelting vessel is used to produce molten iron and the metalliferous material comprises iron ore fines.

The use of an internal cooling water system in a solids injection lance, such as the lance disclosed in U.S. Pat. No. 6,398,842, is a safety issue that is a serious consideration in lance design. It is critical that solid feed material does not wear through the wall of the core tube of the lance and form a puncture and expose the water-cooling system to solid feed material, with a potential risk of an explosion.

A further consideration is that it is desirable that a direct smelting plant operate for a smelting campaign of 12 months or longer. It is therefore desirable to operate solids injection lances for as long as possible, taking into account safety considerations.

There are different types of solids injection lances for direct smelting vessels to the above-described water-cooled lance disclosed in U.S. Pat. No. 6,398,842. Other such lances include lances that separately inject solid feed material and an oxygen-containing gas into direct smelting vessels. These lances may or may not be water-cooled lances but are nevertheless subject to the same safety considerations arising from abrasive wear resulting in punctures of the solids injection components of the lances.

The present invention provides an effective and reliable solids injection lance for injecting metalliferous material and/or carbonaceous material into a direct smelting vessel.

The above description is not to be taken as an admission of the common general knowledge in Australia or elsewhere.

SUMMARY OF THE DISCLOSURE

The solids injection lance of the present invention minimises the risks and safety concerns arising from abrasive wear of the solids injection components of a solids injection lance resulting in punctures by means of an effective puncture detection system.

The solids injection lance of the present invention includes (a) a tube that defines a passageway for solid feed material to be injected through the tube and has an inlet for solid material at a rear end and an outlet for discharging solid material at a forward end of the tube and (b) a puncture detection system for detecting a puncture in the solids injection tube.

The puncture detection system may be adapted to detect a change of pressure in the solids injection tube or a flow of a gas into or from the tube as a result of a puncture in the tube.

The solids injection lance may include a water cooling system, and the puncture detection system may be located between the solids injection tube and the cooling water system. In this instance, the purpose of the puncture detection system is to detect a puncture before the puncture can extend to the internal cooling water system, with potentially catastrophic results.

The water cooling system may be an outer annular cooling jacket that includes an internal water cooling system.

The invention is not confined to the arrangement described in the two preceding paragraphs, even though water-cooled solids injection lances are the focus of the description of the invention.

By way of example, the invention also extends to lances that separately inject solid feed materials and an oxygen-containing gas and do not include a water cooling system and it is important to detect a puncture in the solids injection component of the lance before the puncture can extend to the oxygen gas injection component of the lance.

By way of particular example, the solids injection lance may include the solids injection tube and a system for injecting an oxygen-containing gas through the lance from a rearward end to a forward end of the lance, and the puncture detection system may be located between the solids injection tube and the gas injection system. In this instance, the purpose of the puncture detection system is to detect a puncture before the puncture can extend from the solids injection tube to the gas injection system, with potentially catastrophic results.

The gas injection system may include one or more than one separate gas parallel tubes at spaced intervals around the lance.

The gas injection system may include an annular chamber.

The term "oxygen-containing gas" is understood herein to mean any gas that contains at least some oxygen. By way of example, the term extends to air, 100% oxygen, and oxygen-enriched air.

The solids injection tube may be a central core tube of the lance.

The puncture detection system may include an annular chamber radially outwardly of the core tube, and the puncture detection system may be adapted to detect a change of pressure in the annular chamber or a flow of a gas into or from the annular chamber as a result of a puncture in the core tube.

The puncture detection system may include an annular chamber radially outwardly of the core tube, a sensor for detecting a change of pressure in the annular chamber or the core tube or a flow of a gas into or from the annular chamber or the core tube which indicates that there is a puncture in the core tube, and an alarm that is responsive to the sensor to indicate a puncture in the core tube.

The change of pressure or gas flow may be a decrease in pressure in the annular chamber or an inward flow of gas into the annular chamber when the core tube is punctured.

For example, the annular chamber may contain an inert gas under a pressure that is higher than the average gas pressure in the core tube so that, in use, inert gas flows into the passageway in the core tube from the annular chamber when the core tube is punctured.

The chamber may include an inlet through which the inert gas may be supplied to the chamber to maintain the gas pressure in the chamber.

In use of this arrangement, if solid particulate material wears through the core tube, the inert gas under pressure in the annular chamber flows through the puncture into the passageway defined by the core tube and stops altogether or minimises further wear of the core tube in that part of the core tube by the feed material in the core tube and is advantageous on this basis alone. Furthermore, the flow of the inert gas from the annular chamber into the core tube results in an increase in the flow of the inert gas into the annular chamber, and the flow increase is detected by the sensor. The sensor activates an alarm that the core tube has been punctured. The alarm initiates a procedure to replace the lance. The flow of the inert gas under pressure in the annular chamber through the puncture provides a reasonable time window to replace the defective core tube.

The change of pressure or gas flow may be an increase in pressure in the annular chamber or an outward flow of gas from the annular chamber due to gas flowing into the annular chamber from the passageway in the core tube when the core tube is punctured.

For example, the annular chamber may contain an inert gas under a pressure that is lower than the average gas pressure in the core tube so that, in use, gas flows into the annular chamber from the passageway in the core tube when the core tube is punctured.

The annular chamber may be under vacuum.

The advantages of the lance of the present invention include:

Safety—both in terms of detecting a puncture and allowing time (typically several hours) for lance replacement.

An opportunity for longer operating runs before lance replacement—maximise core tube life the core tube may need to be replaced earlier than necessary as part of a preventative maintenance program in the absence of the puncture detection system.

An opportunity to modify the injection parameters, the core tube material or the manufacturing techniques of the core tube which may affect its life without having to rebuild a history to judge the life expectancy.

The radial depth of the annular chamber may be 1-5 mm.

The annular chamber may extend substantially along the length of the annular cooling jacket.

The inert gas may be any suitable inert gas.

The inert gas may be nitrogen.

The gas pressure in the annular chamber may any suitable pressure in relation to the average pressure in the core tube. As indicated above, the annular chamber may be under vacuum.

The gas pressure in the annular chamber may be selected to cause a flow of the inert gas from the annular chamber into or out of the core tube via a puncture in the core tube against or due to the internal pressure in the core tube.

The actual pressure required in any given situation will depend on a range of factors, including the mechanical design in this section of the lance.

By way of example only, in situations in which the gas pressure in the annular chamber is selected to be greater than the average gas pressure in the core tube, the gas pressure in the annular chamber may be at least 1 bar gauge, typically at least 2 bar gauge, and typically 5-15 bar.

The core tube may be made from a structural material and may include an internal lining or facing of a wear resistant material, such as a white cast iron, such as a ferrochromium white cast iron, ceramic or a mixture of both.

The core tube may comprise an assembly of an outer tube of a structural material and an inner tube of a wear resistant material that are bonded together.

The outer tube may be formed from a steel, such as a stainless steel.

The outer tube may be at least 1 mm thick.

The thickness of the outer tube may be in the range of 3-30 mm.

The inner tube may be formed from a wear resistant lining made of a white cast iron, such as a ferrochromium white cast iron, ceramic or a mixture of both.

The wear resistant lining may be at least 3 mm thick and more preferably at least 5 mm thick.

The bond between the outer tube and the inner tube may extend at least substantially across the whole of the surface area of the interface between the two tubes.

The bond between the outer tube and the inner tube in case of metallic liner may be a metallurgical bond.

The core tube may be at least 2 m long.

The core tube may have a minimum internal diameter of 50 mm.

The core tube may have a maximum internal diameter of 300 mm.

The core tube may have a maximum external diameter of 400 mm.

The present invention further provides a direct smelting plant that includes a direct smelting vessel having at least one solids injection lance as described above.

The present invention further provides a molten bath-based direct smelting process for producing a molten metal from a solid metalliferous feed material that includes injecting a solid feed material, such as the metalliferous feed material, into a molten bath in a direct smelting vessel via at least one solids injection lance as described above and monitoring the lance to detect a puncture in the lance.

The process may include checking for a change of pressure in the solids injection tube of the solids injection lance or a flow of a gas into or from the tube as a result of a puncture in the tube.

The process may include supplying an inert gas to the annular chamber of the solids injection lance to maintain the internal gas pressure in the annular chamber and checking for a change of inert gas flow into to maintain the internal gas pressure.

One example of a metalliferous feed material is iron ore.

The iron ore may be iron ore fines.

The iron ore may be pre-heated to a temperature of at least 600° C.

The process may include injecting metalliferous feed material, a solid carbonaceous material, a flux or any other solid material into the smelting vessel containing a bath of molten material in the form of molten metal and molten slag and generating a bath/slag fountain via gas evolution in the molten bath and generating an offgas and smelting metalliferous material in the molten bath and forming molten metal.

The process may include preheating the metalliferous material by combusting a fuel gas at a temperature of less than 300° C., with the fuel gas being produced from offgas discharged from the smelting vessel. The fuel gas may be a fuel gas produced from hot off-gas released from the smelting vessel and cooled to the temperature of less than 300° C.

The present invention also provides an apparatus for a molten bath-based smelting process for producing molten metal from a metalliferous feed material which includes a direct smelting vessel having at least one solids injection lance as described above and at least one lance for injecting an oxygen-containing gas, the direct smelting vessel containing a bath of molten material in the form of molten metal and molten slag and generating a bath/slag fountain via gas evolution in the molten bath and generating an offgas and smelting preheated metalliferous feed material and forming molten metal.

The apparatus may include a pre-heater for preheating metalliferous feed material and an offgas treatment system for cooling offgas discharged from the smelting vessel and supplying the cooled offgas at a temperature of less than 300° C. to the pre-heater for use as a fuel gas for preheating metalliferous feed material in the pre-heater.

BRIEF DESCRIPTION OF THE DRAWINGS

The invention is described further by way of example only with reference to the accompanying drawings, of which.

DESCRIPTION OF EMBODIMENT

Figure 1:
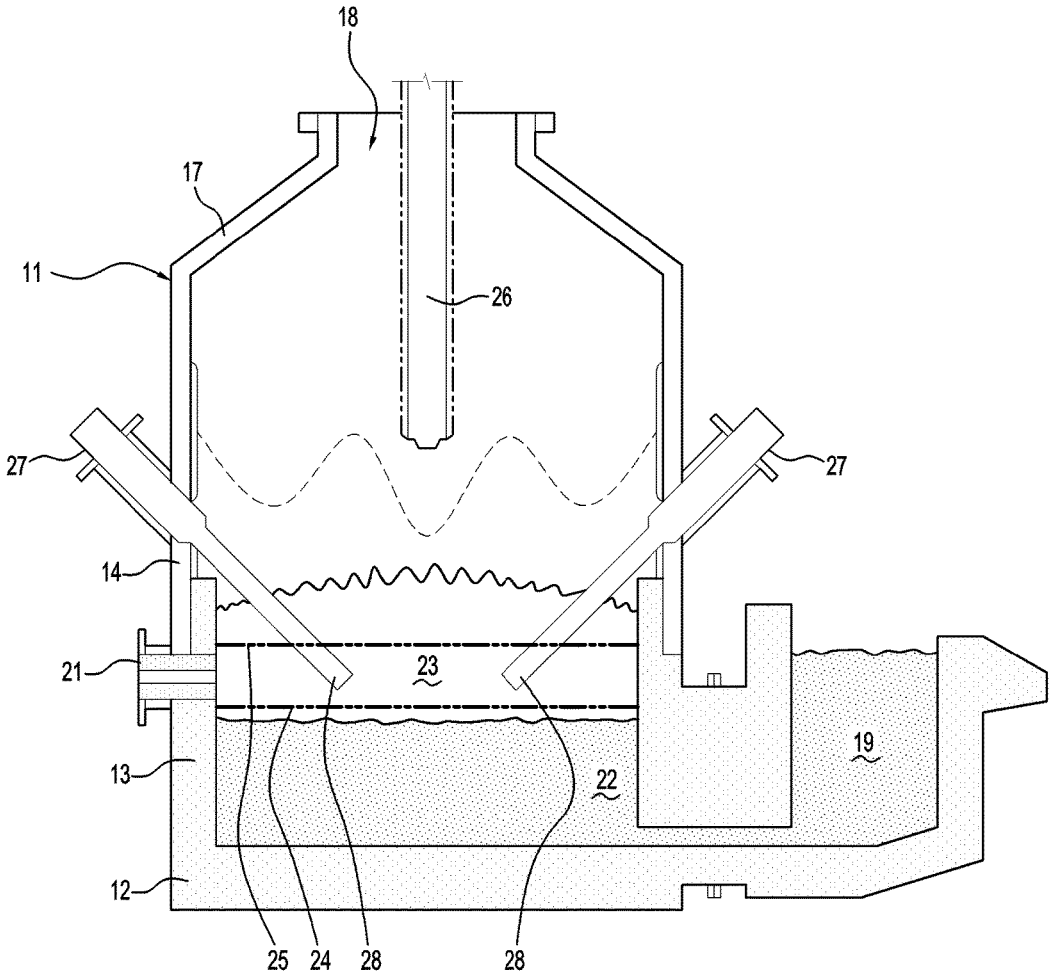
FIG. 1 is a vertical cross-section through a direct smelting vessel.

FIG. 1 shows a direct smelting vessel 11 that is suitable particularly for carrying out the HIsmelt process as described by way of example in International patent application PCT/AU96/00197 (WO 1996/031627) in the name of the applicant. The vessel 11 forms part of a direct smelting plant (not shown) that includes apparatus for storing and supplying feed materials to the vessel 11 and for handling/processing molten metal, slag and off-gas discharged from the vessel 11.

The following description is in the context of smelting iron ore fines to produce molten iron in accordance with the HIsmelt process.

It will be appreciated that the present invention is applicable to smelting any metalliferous material, including ores, partly reduced ores, and metal-containing waste streams via any suitable molten bath-based direct smelting process and is not confined to the HIsmelt process. It will also be appreciated that the ores can be in the form of iron ore fines.

The vessel 11 has a hearth that includes a base 12 and sides 13 formed from refractory bricks, side walls 14, which form a generally cylindrical barrel extending upwardly from the sides 13 of the hearth, and a roof 17. Water-cooled panels (not shown) are provided for transferring heat from the side walls 14 and the roof 17. The vessel 11 is further provided with a forehearth 19, through which molten metal is continuously discharged during smelting, and a tap-hole 21, through which molten slag is periodically discharged during smelting. The roof 17 is provided with an outlet 18 through which process off gases are discharged.

In use of the vessel 11 to smelt iron ore fines to produce molten iron in accordance with the HIsmelt process, the vessel 11 contains a molten bath of iron and slag, which includes a layer 22 of molten metal and a layer 23 of molten slag on the metal layer 22. The position of the nominal quiescent surface of the metal layer 22 is indicated by arrow 24. The position of the nominal quiescent surface of the slag layer 23 is indicated by arrow 25. The term "quiescent surface" is understood to mean the surface when there is no injection of gas and solids into the vessel 11.

The vessel 11 is provided with solids injection lances 27 that extend downwardly and inwardly through openings (not shown) in the side walls 14 of the vessel and into the slag layer 23. In use, feed materials in the form of iron ore fines and/or solid carbonaceous material (such as, for example, coal or coke breeze) and fluxes are entrained in a suitable carrier gas (such as an oxygen-deficient carrier gas, typically nitrogen) and injected through outlet ends 28 of the lances 27 into the metal layer 22.

The outlet ends 28 of the lances 27 are above the surface of the metal layer 22 during operation of the process. This position of the lances 27 reduces the risk of damage through contact with molten metal and also makes it possible to cool the lances by forced internal water cooling, as described further below, without significant risk of water coming into contact with the molten metal in the vessel 11.

The vessel 11 also has a gas injection lance 26 for delivering a hot air blast into an upper region of the vessel 11. The lance 26 extends downwardly through the roof 17 of the vessel 11 into the upper region of the vessel 11. In use, the lance 26 receives an oxygen-enriched hot air flow through a hot gas delivery duct (not shown), which extends from a hot gas supply station (also not shown).

Figure 2:
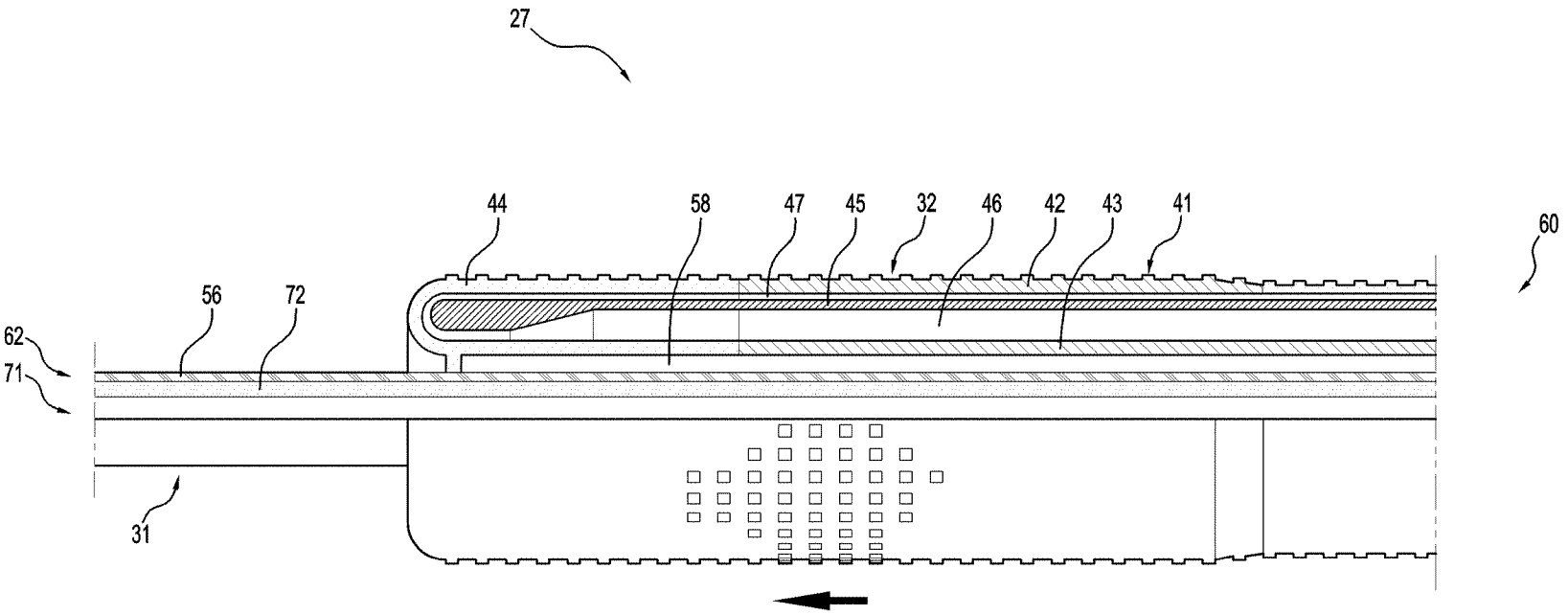
FIG. 2 is a longitudinal partial cross-section view of one embodiment of a solids injection lance in accordance with the present invention for injecting ore into the vessel shown in FIG. 1.
Figure 3:
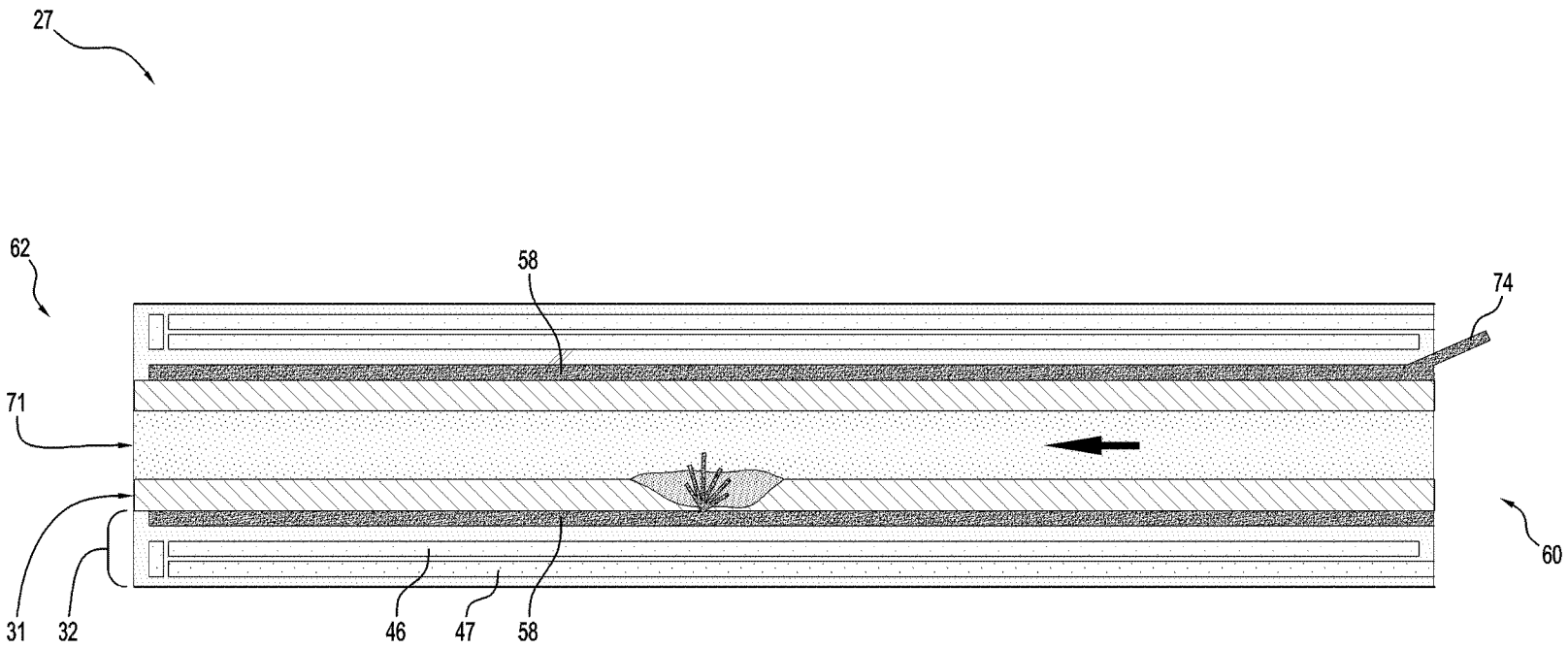
FIG. 3 is a diagrammatic cross-sectional view of a section of the lance shown in FIG. 2 which illustrates puncture injection system of the lance.

FIGS. 2 and 3 illustrate the general construction of one embodiment of a solids injection lance 27 in accordance with the present invention.

The lance 27 comprises a core tube in the form of a core tube assembly 31 in the form of a tube that defines a passageway 71 for solid material in the form of iron ore fines and/or carbonaceous material entrained in a suitable carrier gas to pass from an inlet end 60 to a forward end 62 of the lance 27 in the direction of the arrows in the Figures.

With reference to FIG. 2, the core tube assembly 31 comprises an outer tube section 56 of a structural material, such as a stainless steel, and an inner tube section 72 of a wear resistant material, such as a ferrochromium white cast iron. The inner and outer tube sections 56 and 72 are bonded together metallurgically. Typically, the metallurgical bond is across the entire surface area of the interface between the tube sections. The inner and outer tube sections 56 and 72 may be any suitable thicknesses. The outer tube section 56 provides the structural requirements of the core tube assembly 31. The inner tube section 72 provides the wear resistance requirements of the core tube assembly 31. Each tube section 56, 72 is separately formed to optimise the structural and the wear resistance requirements.

The lance 27 also comprises an annular cooling jacket 32 surrounding the core tube assembly 31 and extending over a substantial part of the length of the core tube assembly 31. The annular cooling jacket 32 includes a cooling water system for the lance 27.

The annular cooling jacket 32 is in the form of a long hollow annular structure 41 having outer and inner tubes 42 and 43 respectively interconnected by a front end connector piece 44. An elongate tubular structure 45 is disposed within the hollow annular structure 41 so as to divide the interior of the structure 41 into an inner elongate annular water flow passage 46 and an outer elongate annular water flow passage 47. The rear end (not shown) of the annular cooling jacket 32 of the lance 27 is provided with a water inlet (also not shown) through which a flow of cooling water can be directed into the inner annular water flow passage 46 and a water outlet (also not shown) from which water is extracted from the outer annular passage 47 at the rear end of the lance 27. This arrangement of water flow passages 46, 47 and water inlets and outlets defines the cooling water system. Accordingly, in use of the lance 27, cooling water flows forwardly down the lance through the inner annular water flow passage 46, radially outward through the connector piece 44, and then backwardly through the outer annular passage 47 along the lance 27. Thus, cooling water provides effective cooling of the lance 27 when exposed to the heat generated within the smelting vessel 11, when in use.

The lance 27 also comprises a puncture detection system for detecting a puncture in a wall of the core tube assembly 31 located between the core tube assembly 31 and the cooling water system housed in the annular cooling jacket 32.

With particular reference to FIG. 3, the puncture detection system includes an annular chamber 58 between the core tube assembly 31 and the annular cooling jacket 32 (and therefore the cooling water system). The annular chamber 58 may be any suitable radial thickness. Typically, the radial thickness of the annular chamber 58 is 1-5 mm. The annular chamber 58 contains nitrogen or any other suitable inert gas or any other suitable gas under pressure. The nitrogen is supplied to the annular chamber 58 via an inlet 74 to maintain the chamber at a predetermined gas pressure. The gas pressure is selected to be sufficient to cause a flow of nitrogen from the annular chamber 58 into the core tube assembly 31 via a puncture in the core tube assembly 31 against the internal pressure in the core tube assembly 31. The preferred gas pressure in any given situation will depend on a range of factors including the mechanical design in this section of the lance 27 and the operating pressures for solid feed material injection via the core tube assembly 31. Typically, the gas pressure will be at least 2 bar gauge, more typically in a range of 2-15 bar gauge, and more typically again in a range of 5-12 bar gauge.

The puncture detection system also includes a sensor (not shown) for detecting a flow of nitrogen into the annular chamber 58 via the inlet 74 which indicates that there is a drop in the pressure in the annular chamber 58 and thereby a puncture in the core tube assembly 31. By way of example, the sensor may be arranged to detect an increase in the flow of the inert gas into the annular chamber 58 via the inlet 74 that is required to maintain the predetermined gas pressure in the chamber 58.

The puncture detection system also includes an alarm (not shown) that is responsive to the gas flow sensor to indicate a puncture in the core tube assembly 31. The alarm may be any suitable alarm, visual and/or audible, in a control room for the vessel 11

In use, if solid particulate material, such as hot iron ore fines, wears through the core tube assembly 31 and forms a puncture (shown by the numeral 76 in FIG. 3) in the assembly 31, the nitrogen gas under pressure in the annular chamber 58 flows through the puncture into the passageway defined by the core tube assembly 31 and stops altogether or minimises further wear of the core tube assembly 31 in that part of the core tube assembly 31 by the feed material in the core tube and is advantageous on this basis alone. Furthermore, the flow of nitrogen from the annular chamber 58 into the core tube assembly 31 results in an increase in the flow of nitrogen into the annular chamber 58 via the inlet 74, and the flow increase is detected by the sensor. The sensor activates an alarm that the core tube assembly 31 has been punctured. The alarm initiates a procedure to replace the lance 27. This procedure may be any suitable procedure including (a) changing HIsmelt process operating conditions to a "hold" state to allow safe replacement of the lance 27, including stopping supply of feed materials to the lance 27, (b) disconnecting the lance 27 from feed material supply lines, (c) removing the lance 27 from the vessel 11, (d) inserting a replacement lance 27, (e) connecting the replacement lance 27 to feed material supply lines, and (f) changing HIsmelt process operating conditions from the "hold" state to the steady-state. The flow of nitrogen under pressure in the annular chamber 58 through the puncture provides a reasonable time window to initiate the replacement procedure and replace the lance 27.

The puncture detection system of the lance 27 provides the following advantages:

Safety—both in terms of detecting a puncture and allowing time (typically several hours) for lance replacement.

An opportunity for longer operating runs before core tube replacement—this will maximise lance life. This opportunity arises because the puncture detection system provides a clear indication of the maximum operating life of the lance 27.

An opportunity to modify the injection parameters, the core tube material or the manufacturing techniques of the core tube which may affect its life without having to rebuild a history to judge the life expectancy.

Many modifications may be made to the embodiment of the solids injection lance of the present invention described in relation to the Figures without departing from the spirit and scope of the invention.

By way of example, whilst the puncture detection system is described in relation to the Figures in the context of a water-cooled solids injection lance and the purpose of the puncture detection system is to detect a puncture in the solids injection tube of the lance (which is described as but is not necessarily limited to a central core tube) before it extends to the water cooling system, it can readily be appreciated that the invention is not limited to this type of lance and purpose of the puncture detection system. By way of example, the invention also extends to lances that do not include water cooling systems and separately inject solid feed materials and an oxygen-containing gas and it is important to detect a puncture in the solids injection component of the lance before the puncture can extend to the oxygen gas injection component of the lance.

By way of example, the present invention is not limited to the particular construction of the lance components of the core tube assembly 31 and the annular cooling jacket 32 and the materials from which these lance components are constructed described in relation to the Figures. The present invention is applicable to any water-cooled solids injection lance made from any suitable materials.

By way of example, the present invention is not limited to the core tube assembly 31 comprising an outer tube section 56 of a structural material and an inner tube section 72 of a wear resistant material bonded together metallurgically described in relation to the Figures.

By way of example, whilst the puncture detection system of the lance 27 shown in the drawings includes the annular chamber 58 that contains nitrogen under pressure, with the annular chamber 58 including an inlet 74 through which nitrogen is supplied to the annular chamber 58 to maintain a gas pressure in the chamber, a sensor for detecting a flow of inert gas into the annular chamber which indicates that there is a puncture in the core tube, and an alarm that is responsive to the gas flow sensor to indicate a puncture in the core tube assembly 31, the present invention is not so limited and extends to any system for detecting a puncture in the core tube assembly 31.

For example, the present invention extends to any system for detecting a change in pressure in the core tube assembly 31 or the annular chamber 58 that indicates a puncture in the core tube assembly 31. The pressure change may be an increase in pressure in the annular chamber 58 or a decrease in the pressure in the annular chamber 58.

By way of example, whilst the embodiment of the solids injection lance is described in the context of the HIsmelt direct smelting process, it can readily be appreciated that the present invention is not so limited and extends to any molten bath-based smelting process.

By way of example, whilst the embodiment of the solids injection lance is described in the context of smelting iron ore, it can readily be appreciated that the present invention is not limited to this material and extends to any suitable metalliferous material.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A solids injection lance includes a tube that defines a passageway for solid feed material to be injected through the tube and has an inlet for the solid feed material at a rear end and an outlet for discharging the solid feed material at a forward end of the tube and a system for detecting a puncture in the tube, the system includes an annular chamber radially outwardly of the tube, wherein the annular chamber contains an inert gas and the system is adapted to detect a change in pressure of the inert gas for detecting the puncture in the tube.

2. The solids injection lance defined in claim 1 wherein the system for detecting the puncture is adapted to detect a change of pressure in the tube or a flow of gas into or from the tube as a result of the puncture in the tube.

3. The solids injection lance defined in claim 1 includes a water cooling system, and the system for detecting the puncture is located between the tube and the water cooling system.

4. The solids injection lance defined in claim 1 includes a gas injection system for injecting an oxygen-containing gas through the solids injection lance from a rearward end to a forward end of the solids injection lance, and the system for detecting the puncture is located between the tube and the gas injection system.

5. The solids injection lance defined in claim 1 wherein the tube is a central core tube of the solids injection lance.

6. The solids injection lance defined in claim 5 wherein the the system for detecting the puncture is adapted to detect a change of pressure in the annular chamber or a flow of gas into or from the annular chamber as a result of a puncture in the tube.

7. The solids injection lance defined in claim 5 wherein the system for detecting the puncture includes the annular chamber radially outwardly of the tube, a sensor for detecting a change of pressure in the annular chamber or the tube or a flow of gas into or from the annular chamber or the tube which indicates that there is a puncture in the tube, and an alarm that is responsive to the sensor to indicate the puncture in the tube.

8. The solids injection lance defined in claim 6 wherein the change of pressure or gas flow is a decrease in pressure in the annular chamber or an inward flow of gas into the annular chamber when the tube is punctured.

9. The solids injection lance defined in claim 8 wherein the inert gas in the annular chamber is under a pressure that is higher than average gas pressure in the tube so that in use, inert gas flows into the passageway in the tube from the chamber when the tube is punctured.

10. The solids injection lance defined in claim 9 wherein the annular chamber includes an inlet through which the inert gas is supplied to the annular chamber to maintain the gas pressure in the annular chamber.

11. The solids injection lance defined in claim 6 wherein the change of pressure or gas flow is an increase in pressure in the annular chamber or an increase in outward flow of gas from the annular chamber due to gas flowing into the annular chamber from the passageway in the tube when the tube is punctured.

12. The solids injection lance defined in claim 11 wherein the annular chamber contains the inert gas under a pressure that is lower than average gas pressure in the tube.

13. The solids injection lance defined in claim 11 wherein the annular chamber is under vacuum.

14. The solids injection lance defined in claim 1 wherein the annular chamber is defined with a radial depth of 1-5 mm.

15. The solids injection lance defined in claim 1 wherein the annular chamber extends substantially along length of an annular cooling jacket.

16. The solids injection lance defined in claim 1 wherein the inert gas is nitrogen.

17. A molten bath-based direct smelting process for producing a molten metal from a solid metalliferous feed material that includes:

injecting the solid feed material into a molten bath in a direct smelting vessel via at least one solids injection lance defined in claim 1 and monitoring the solids injection lance by a system to detect a puncture in the solids injection lance.

18. The molten bath-based direct smelting process defined in claim 17 includes checking for a change of pressure in the tube of the solids injection lance or a flow of a gas into or from the tube as a result of the puncture in the tube.

19. The molten bath-based direct smelting process defined in claim 17 includes supplying an inert gas to the annular chamber of the solids injection lance to maintain internal gas pressure in the annular chamber and checking for a change of inert gas flow into to maintain the internal gas pressure.

20. An apparatus for a molten bath-based smelting process for producing molten metal from a metalliferous feed material which includes:

a direct smelting vessel having at least one solids injection lance defined in claim 1; and at least one gas injection lance for injecting an oxygen-containing gas, the direct smelting vessel containing a bath of molten material in the form of molten metal and molten slag and generating a bath/slag fountain via gas evolution in the molten bath and generating an offgas and smelting preheated metalliferous feed material and forming molten metal.

* * * * *